US008603267B2

(12) United States Patent
Watson

(10) Patent No.: US 8,603,267 B2
(45) Date of Patent: Dec. 10, 2013

(54) EXTRUSION OF GLASSY ALUMINUM-BASED ALLOYS

(75) Inventor: Thomas J. Watson, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 235 days.

(21) Appl. No.: 13/169,204

(22) Filed: Jun. 27, 2011

(65) Prior Publication Data

US 2012/0325378 A1 Dec. 27, 2012

(51) Int. Cl.
*C22F 1/04* (2006.01)

(52) U.S. Cl.
USPC ..... 148/561; 148/689

(58) Field of Classification Search
None
See application file for complete search history.

(56) References Cited

U.S. PATENT DOCUMENTS

| | | | | |
|---|---|---|---|---|
| 1,290,011 | A | 12/1918 | Hirsch | |
| 4,122,240 | A | 10/1978 | Banas et al. | |
| 4,479,293 | A | 10/1984 | Miller et al. | |
| 4,530,229 | A | 7/1985 | Walker | |
| 5,435,161 | A * | 7/1995 | King | 72/16.5 |
| 5,458,700 | A * | 10/1995 | Masumoto et al. | 148/403 |
| 6,974,510 | B2 | 12/2005 | Watson | |
| 7,413,621 | B2 | 8/2008 | Watson | |
| 2004/0055671 | A1 * | 3/2004 | Olson et al. | 148/561 |
| 2004/0170522 | A1 | 9/2004 | Watson | |
| 2006/0048699 | A1 | 3/2006 | D'Evelyn et al. | |
| 2007/0289680 | A1 | 12/2007 | Watson | |
| 2008/0308197 | A1 * | 12/2008 | Watson et al. | 148/559 |
| 2011/0085932 | A1 | 4/2011 | Pandey | |
| 2011/0091346 | A1 | 4/2011 | Pandey | |

* cited by examiner

*Primary Examiner* — George Wyszomierski

(74) *Attorney, Agent, or Firm* — Kinney & Lange, P.A.

(57) ABSTRACT

A method of extruding a glassy aluminum-based alloy billet, by soaking the billet for sufficient time to heat the billet to an extrusion starting temperature of from about 300° F. to about 600° F. and extruding the billet in a streamline die having an extrusion ratio to keep the adiabatic temperature below the starting temperature while maintaining the streamline die at a temperature of about 400° F. to about 600° F. at a ram speed less than that which would raise the streamline die temperature within this range.

9 Claims, 1 Drawing Sheet

EXTRUSION OF GLASSY ALUMINUM-BASED ALLOYS

CROSS-REFERENCE TO RELATED APPLICATION(S)

This application is related to the following applications that are filed on even date herewith and are assigned to the same assignee: DIFFUSION BONDING OF GLASSY ALUMINUM-BASED ALLOYS, Ser. No. 13/169,194 (now abandoned); MASTER ALLOY PRODUCTION FOR GLASSY ALUMINUM-BASED ALLOYS, Ser. No. 13/169,202 (now abandoned); PRODUCTION OF ATOMIZED POWDER FOR GLASSY ALUMINUM-BASED ALLOYS, Ser. No. 13/169,207; and FORGING OF GLASSY ALUMINUM-BASED ALLOYS, Ser. No. 13/169,210. All referenced incorporated herein.

BACKGROUND

Aluminum alloys are important in many industries. Glassy Al-based alloys and their devitrified derivatives are currently being considered for structural applications in the aerospace industry. These alloys involve the addition of rare earth and transition metal elements. These alloys have high strength and, when processed appropriately, have high ductility.

One of the key requirements for high ductility is control of the second phase size during thermomechanical processing; in this case, extrusion into various extruded shapes.

When aluminum or aluminum alloys are extruded, the alloys, depending on the alloy composition, are heated to between 700° F. (375° C.) and 800° F. (427° C.), and are extruded through shear-faced dies with a high extrusion ratio and at high ram speeds. This functions to impart as much "work" into the alloy as possible. There is no concern for adiabatic heating because the alloys are usually heat-treatable. The alloys can be solutionized, quenched and aged to a desireable temper after extrusion.

Because glassy Al-based alloys have different structures, the temperatures noted above along with adiabatic heating from the shear-faced dies promote almost instantaneous devitrification so that the benefits of the glassy state are lost. Also, derivatives of the glassy state produce nanocrystalline microstructures that have mechanical properties that cannot be obtained when starting out with powder in the crystalline state. Al-based alloys such as Al—Y—Ni—Co alloys are devitrified glass-forming aluminum alloys that derive their strength from a nanometer-sized grain structure and nanometer-sized intermetallic second phase or phases. Examples of such alloys are disclosed in co-owned U.S. Pat. Nos. 6,974,510 and 7,413,621, the disclosures of which are incorporated herein by reference in their entirety. Both devitrified aluminum alloys with nanocrystalline microstructures and those that are glassy without being devitrified have not been successfully extruded using conventional extrusion practices.

A new approach to extrusion of glassy Al-based powder is needed.

SUMMARY

The present invention includes a process for extruding aluminum alloys that are initially at least partially glassy in powder or melt-spun ribbon, and those that are then devitrified during processing and are fully devitrified during the consolidation step, such as hot pressing and/or during extrusion. The extrusion process of this invention provides for retention of the nano-scale microstructure. Temperature and strain are minimized by the use of streamline dies under controlled conditions.

Of particular use are aluminum based alloys containing from 3 to 18.5 atomic percent nickel and 3 to 14.0 atomic percent yttrium.

DETAILED DESCRIPTION

Figure 1:
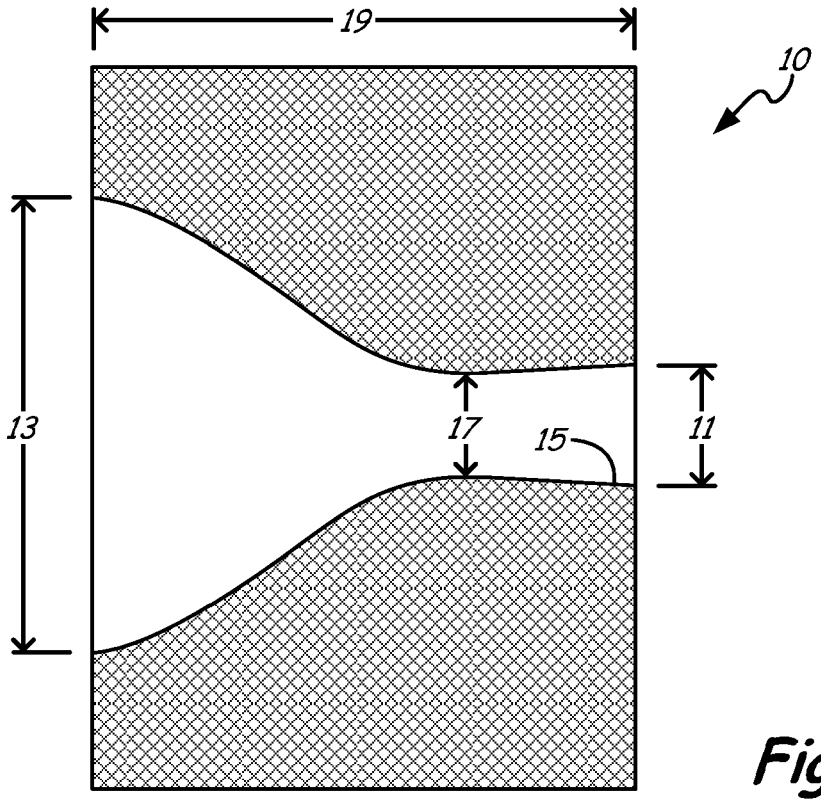
FIG. 1 is a cross section of a streamlined die for extruding the aluminum devitrified alloys of this invention.

FIG. 1 illustrates a streamline die 10 for extrusion of aluminum alloys and other materials. Die 10 is effective in minimizing the effect of temperature and total strain on the extruded product. Die 10 promotes the elimination/minimization of redundant work, thereby lowering the total plastic strain. Consequently, adiabatic heating is also reduced. The extrusion ratio, the cross-section for output end 11 divided into the cross-section for input end 13, can range from 1.1 to 50, depending on the material being extruded. For the alloys used in this invention, optimum results are obtained with an extrusion ratio from about 10:1. The opening 15 of the output end 11 is slightly tapered to prevent smearing, so that the only contact by the billet on the die is in extrusion region 17. Working length 19 cam range from 1 inch to sixty inches, though the more effective ranges is 4 inches to 6 inches.

Figure 2:
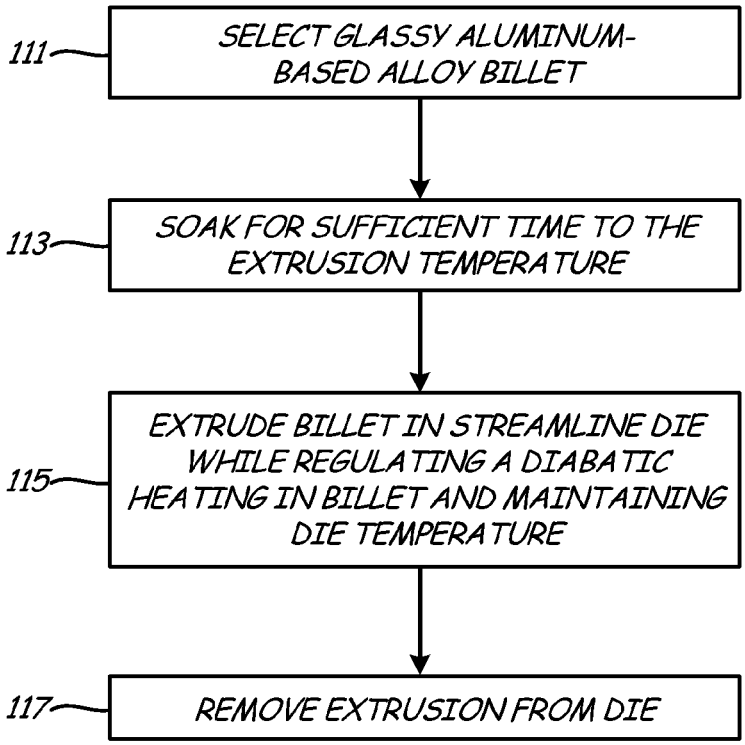
FIG. 2 is a block flow diagram of the extrusion process of this invention.

The alloys extruded by the present method are glassy aluminum based alloys, some of which are devitrified, having a nanocrystalline microstructure, and some of which remain glassy with substantially no devitrification. As noted in FIG. 2, the appropriate glassy aluminum based alloy billet is selected in Step 111.

The billets are heated in a soak furnace, Step 113, for sufficient time to heat the billet to an extrusion starting temperature of from about 300° F. to about 600° F. (148.9° C. to 315.6° C.). When the alloy is a devitrified alloy, the starting temperature is about 450° F. to about 550° F. (232.2° C. to 287.9° C.) and the soak time is from about 10 minutes to about 72 hours. When the alloy is a glassy alloy, the starting temperature is about 400° F. to about 575° F. (204.4° C. to 301.7° C.) and the soak time is from about 10 minutes to about 5 hours.

Step 115 is the actual extrusion step, where the billet is extruded in a streamline die 10 having an extrusion ratio sufficient to keep the adiabatic temperature below the starting temperature while maintaining streamline die 10 at a temperature of about 400° F. to about 600° F. (204.4° C. to 315.6° C.) at a ram speed less than that which would raise the streamline die temperature within this range. When the alloy is a devitrified alloy, the streamline die is maintained at a temperature ranging from about 400° F. to about 575° F. (204.4° C. to 301.7° C.) at a ram speed of from about 0.1 to 100 inches per minute. When the alloy is a glassy alloy, the streamline die is maintained at a temperature ranging from about 475° F. to about 525° F. (246.1° C. to 273.9° C.) at a ram speed of from about 0.1 to 5 inches per minute.

Step 117 is a conventional step of removing the extrusion from die 10 via torching, shearing, etc.

Use of the method of this invention has produced extruded parts from devitrified alloys that retain the nanocrystalline microstructure and, thus, the superior strength of those alloys. Similarly, the method of this invention has produced extruded parts from glassy aluminum alloys having substantially no devitrification, also without loss of the superior properties of these alloys.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of extruding an aluminum-based alloy, comprising the steps of:

selecting an aluminum-based alloy billet, wherein the aluminum based alloy is selected from the group consisting of a devitrified alloy having a nanocrystalline microstructure and a glassy aluminum alloy having substantially no devitrification;

soaking the billet for sufficient time to heat the billet to an extrusion starting temperature of from about 450° F. to about 550° F. (232.2° C. to 287.9° C.), wherein a time for the soaking is from about 10 minutes to about 72 hours;

extruding the billet in a streamline die having an extrusion ratio sufficient to keep the adiabatic temperature below the starting temperature while maintaining the streamline die at a temperature of about 400° F. to about 600° F. (204.4° C. to 315.6° C.) at a ram speed less than that which would raise the streamline die temperature within this range; and removing the extruded billet from the die.

2. The method of claim 1, wherein the aluminum based alloy is an aluminum based alloy containing from 3 to 18.5 atomic percent nickel and 3 to 14.0 atomic percent yttrium.

3. The method of claim 1, wherein the streamline die is maintained at a temperature ranging from about 400° F. to about 575° F. (204.4° C. to 301.7° C.) at a ram speed of from about 0.1 to 100 inches per minute.

4. The method of claim 1, wherein the streamline die is maintained at a temperature ranging from about 475° F. to about 525° F. (246.1° C. to 273.9° C.) at a ram speed of from about 0.1 to 5 inches per minute.

5. The method of claim 1, wherein the streamline die has an extrusion ratio of from about 1 to about 10, and has a length ranging from about 4 inches to 6 inches (10.16 cm. to 15.24 cm.).

6. A method of extruding a devitrified aluminum-based alloy, comprising the steps of:

selecting a devitrified aluminum-based alloy billet having a nanocrystalline microstructure;

soaking the billet having a nanocrystalline microstructure for sufficient time to heat the billet to an extrusion starting temperature of from about 450° F. to about 550° F. (232.2° C. to 287.9° C.), wherein a time for the soaking is from about 10 minutes to about 72 hours;

extruding the billet in a streamline die having an extrusion ratio sufficient to keep the adiabatic temperature below the starting temperature while maintaining the streamline die at a temperature of about 400° F. to about 600° F. (204.4° C. to 315.6° C.) at a ram speed less than that which would raise the streamline die temperature within this range; and removing the extruded billet from the die.

7. The method of claim 6, wherein the devitrified aluminum based alloy is an aluminum based alloy containing from 3 to 18.5 atomic percent nickel and 3 to 14.0 atomic percent yttrium.

8. The method of claim 7, wherein the streamline die is maintained at a temperature ranging from about 400° F. to about 575° F. (204.4° C. to 301.7° C.) at a ram speed of from about 0.1 to 100 inches per minute.

9. The method of claim 6, wherein the streamline die has an extrusion ratio of from about 1 to about 10, and has a length ranging from about 4 inches to 6 inches (10.16 cm. to 15.24 cm.).

* * * * *